US009920562B2

(12) United States Patent
Stanton

(10) Patent No.: US 9,920,562 B2
(45) Date of Patent: Mar. 20, 2018

(54) DOOR CLOSING MECHANISM HAVING HANDS-FREE HOLD-OPEN FEATURE

(71) Applicant: HAMPTON PRODUCTS INTERNATIONAL CORPORATION, Foothill Ranch, CA (US)

(72) Inventor: Lucas Jeffrey Stanton, Shell Lake, WI (US)

(73) Assignee: HAMPTON PRODUCTS INTERNATIONAL CORPORATION, Foothill Ranch, CA (US)

( * ) Notice: Subject to any disclaimer, the term of this patent is extended or adjusted under 35 U.S.C. 154(b) by 138 days.

(21) Appl. No.: 14/947,788

(22) Filed: Nov. 20, 2015

(65) Prior Publication Data

US 2017/0145726 A1 May 25, 2017

(51) Int. Cl.

| | |
|---|---|
| ***E05F 3/22*** | (2006.01) |
| ***E05F 5/06*** | (2006.01) |
| ***E05F 1/10*** | (2006.01) |

(52) U.S. Cl.

CPC ..... *E05F 3/227* (2013.01); *E05F 1/105* (2013.01); *E05F 3/221* (2013.01); *E05F 5/06* (2013.01)

(58) Field of Classification Search

CPC ..... E05F 3/00; E05F 3/02; E05F 3/22; E05F 3/227; E05F 3/221; E05F 5/00; E05F 5/04; E05F 5/06; E05F 2005/043; E05F 2005/046

See application file for complete search history.

(56) References Cited

U.S. PATENT DOCUMENTS

| | | | | |
|---|---|---|---|---|
| 3,561,036 | A * | 2/1971 | Crane | E05F 3/221 16/49 |
| 4,194,264 | A | 3/1980 | Stoffregen | |
| 4,920,609 | A * | 5/1990 | Lin | E05C 17/085 16/66 |
| 5,517,719 | A * | 5/1996 | Christ | E05F 3/02 16/49 |
| 5,630,248 | A | 5/1997 | Luca | |
| 5,832,562 | A | 11/1998 | Luca | |
| 5,842,255 | A | 12/1998 | Luca | |
| 5,845,360 | A | 12/1998 | Lantzy | |
| 6,615,499 | B1 | 9/2003 | Matsuzawa et al. | |
| 6,634,058 | B1 | 10/2003 | Lin | |
| 6,938,302 | B2 * | 9/2005 | Lin | E05F 1/105 16/72 |
| 6,976,289 | B1 | 12/2005 | Luca | |

(Continued)

*Primary Examiner* — Jeffrey O'Brien

(74) *Attorney, Agent, or Firm* — Klein, O'Neill & Singh, LLP

(57) ABSTRACT

A door closing device for installation between a door and a door jamb includes a closer rod having an end configured to be fixed to the door jamb, the closer rod being movable between a withdrawn position in which the door is closed and an extended position in which the door is opened. The device also has a hold-open mechanism that includes a driver fixed to the closer rod and movable between a release position that permits movement of the closer rod, and a hold position that holds the closer rod in the extended position, and a resilient retainer configured to capture the driver in the hold position. The driver is separated from the retainer by a disengagement force applied to the retainer.

12 Claims, 3 Drawing Sheets

(56) References Cited

U.S. PATENT DOCUMENTS

| | | | |
|---|---|---|---|
| 7,111,359 | B1 | 9/2006 | Luca |
| 7,134,168 | B1 | 11/2006 | Qing |
| 7,216,400 | B2 | 5/2007 | Hodson |
| 7,219,391 | B1 | 5/2007 | Luca |
| 8,196,295 | B2 | 6/2012 | Imafuku et al. |
| 8,307,495 | B1 | 11/2012 | Berkseth |
| 8,443,488 | B2 | 5/2013 | Zhang |
| 8,661,616 | B1 | 3/2014 | Luca |
| 8,713,756 | B2 | 5/2014 | Wu |

* cited by examiner

DOOR CLOSING MECHANISM HAVING HANDS-FREE HOLD-OPEN FEATURE

CROSS-REFERENCE TO RELATED APPLICATION

Not Applicable

FEDERALLY SPONSORED RESEARCH OR DEVELOPMENT

Not Applicable

BACKGROUND

The present disclosure relates generally to door closing devices. More particularly, the disclosure relates to door closing devices having hands-free hold-open mechanisms.

Many commercial and residential doors include an automatic closing mechanism, whereby the door is automatically closed (e.g., by a mechanical spring or a pneumatic cylinder) after it has been opened. In some instances it is desirable to maintain the door in the opened state to provide for persons or objects to pass through the door opening without having to prop the door open or hold it open.

Providing a greater opportunity for persons or objects to pass through the door opening may be desirable for persons carrying articles or objects such as luggage, shopping bags, or packages, persons with small children that may need more time to traverse the door opening, and persons with special needs such as those with physical impairments or the elderly, to name a few.

Thus, door closing mechanisms have been provided that prevent the closing of a door after it has been opened. For example, in door closer mechanisms employing a pneumatic cylinder with a closer rod, a stop element may be carried on the closer rod that can be moved by a user to a position that prevents the closer rod from sliding back into the cylinder, thereby keeping the door open. One drawback of this type of adjustment is that the user must open and hold the door open with one hand and with the other hand reach the door closing mechanism typically located at the top of the door to slide the stop element in place. Another example is a door stop located on the bottom of the door that must be manipulated to swing down by a person's hand or foot to prop the door open after the door has been opened. Each of these examples requires different multiple actions to maintain the door in the open position.

SUMMARY

For purposes of summarizing the disclosure, exemplary concepts have been described herein. It is to be understood that not necessarily all such concepts may be achieved in accordance with any particular embodiment. Thus, for example, those skilled in the art will recognize that embodiments may be carried out in a manner that achieves or optimizes one concept as taught herein without necessarily achieving other concepts as may be taught or suggested herein.

As described in more detail below, the subject matter disclosed herein provides, in one aspect, a door closing device having a hold-open mechanism including a retainer to maintain the opening of a door when the door is open to or just past a predetermined angle. For example, the predetermined angle can be about 85 degrees, although angles of 60-90 degrees may be suitable More specifically, a door closing device according to an embodiment of this disclosure is configured to be connected between a door and a door jamb so as to bias the door from an open position toward a closed position against the door jamb, the device including a closer rod having an end configured to be fixed to the door jamb, the closer rod being movable between a withdrawn position in which the door is closed and an extended position in which the door is opened; a hold-open mechanism comprising: a driver fixed to the closer rod and movable with the closer rod between a release position that permits movement of the closer rod, and a hold position that holds the closer rod in the extended position, the driver having a back end; and a retainer comprising one or more elastic arms and a bore through which the closer rod extends to the door jamb. The driver can be captured by the one or more elastic arms in the hold position and can be separated from the retainer by a disengagement force applied to the one or more elastic arms from the back end of the driver.

In a particular embodiment, one or more of the elastic arms terminates in a snap hook, and an audible sound is produced by the retainer when the driver is captured by the snap hook in the hold position to indicate that the driver is in the hold position and the door is held open at the predetermined angle. An audible sound may also be produced by the retainer when the driver is separated from the retainer to indicate that the driver is in the release position and the door is no longer held open. The audible sound can be produced by rapid movement of the one or more elastic arms.

On the one or more elastic arms that has a snap hook, the snap hook may comprise a protrusion extending radially inward to capture the driver in the hold position. The disengagement force, such as an impact force, to separate the driver from the retainer can be applied to the snap hook. For example, the disengagement force can be about five pounds, but the magnitude of the disengagement force can be anything suitable for a particular application.

The door closing device may also include a spring surrounding the driver and the one or more elastic arms, biasing the driver away from the one or more elastic arms.

A tapered surface can be formed between an outer cylindrical surface of the driver and the front end of the driver to deflect the one or more elastic arms radially outwardly.

In another aspect, this disclosure relates to a door-closing device of the type including a linearly-movable closer rod having one end configured to be fixed to a door jamb and movable between a door closed position and a door open position relative to the door jamb, wherein the closer rod is moved to an extended position when the door is opened, and wherein the closer rod is biased to return to a withdrawn position from the extended position. A hold-open mechanism within the door-closing device comprises a retainer that may advantageously produce an audible sound when the retainer holds a driver on the closer rod to indicate the driver is in a hold position. The audible sound may also be produced by the retainer when the driver is separated from the retainer to indicate that the driver is in the release position. The audible sound can be produced by rapid movement of the at least one arm of the retainer. The rapid movement of the at least one arm can occur after the driver elastically deflects the at least one arm from its original state as the door approaches or retreats from the hold position, and the driver moves away from the at least one arm, thereby causing the at least one arm to snap back into its original state to produce the audible sound.

In still another aspect, this disclosure relates to a method of closing a door, comprising: providing a closer rod movable between a withdrawn position in which the door is closed and an extended position in which the door is opened, and a retainer that holds the closer rod in the extended position at a predetermined hold-open angle; and generating an audible sound when the closer rod is held in the extended position indicating the door is held open. The audible sound can be produced by rapid movement of the at least one arm. The rapid movement of the at least one arm can occur after the closer rod elastically deflects the at least one arm from its original state as the door approaches the hold position or moves away from the hold position, and the closer rod moves away from the at least one arm, thereby causing the at least one arm to snap back into its original state to produce the audible sound.

The method can further include decoupling the closer rod from the retainer, and generating an audible sound when the closer rod is released from the retainer, indicating the door is not held open.

The retainer can include one or more arms holding a driver extending outwardly from the closer rod in the extended position.

These and other aspects and embodiments will become apparent to those skilled in the art from the following detailed description of the various embodiments having reference to the attached figures, the disclosure not being limited to any particular embodiment.

DETAILED DESCRIPTION

Exemplary embodiments will now be described with reference to the accompanying figures, wherein like reference numbers refer to like elements throughout. The terminology used in the description presented herein is not intended to be interpreted in any limited or restrictive manner simply because it is being utilized in conjunction with a detailed description of certain embodiments. Furthermore, various embodiments (whether or not specifically described herein) may include novel features, no single one of which is solely responsible for its desirable attributes or which is essential to practicing any of the embodiments herein described.

The present disclosure relates generally to a door closing mechanism, and more particularly to a door closing mechanism including, among other things, a hold-open device or mechanism that engages automatically to hold the door in an open position at a predetermined angle without additional manipulation, and that allows the door to return to a closed position upon the application of a predetermined closing force to the door.

In some embodiments, the door is held in the open position at the predetermined angle by opening the door past the predetermined angle and allowing the door to close slightly before stopping at the predetermined angle.

In some embodiments, the door may be returned to the closed position by applying a force to the door in a direction towards the closed position, in which the force is large enough to overcome the hold-open device.

In some embodiments, the door may be returned to the closed position by opening the door further and releasing the door to allow the momentum of the closing door generated by the door closing mechanism to generate a closing force large enough to overcome the hold-open device.

In some embodiments, audible feedback may be provided when the door is "held open" to a hold-open position and when the door is returning to a closed position.

Figure 1:
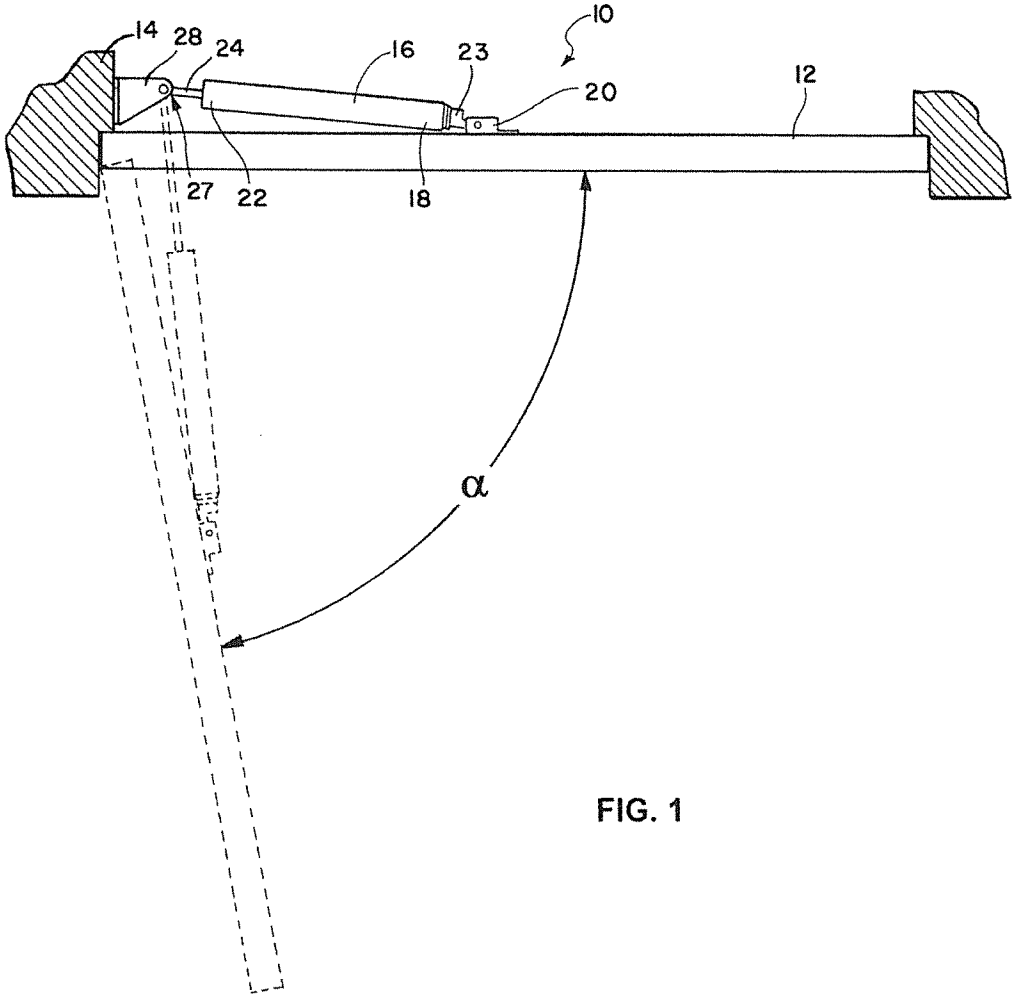
FIG. 1 is a top view showing a door closing device in accordance with an embodiment of the disclosure attached between a door and door jamb.

FIG. 1 shows an embodiment of a door closing device or mechanism 10 installed between a door 12 and a door jamb 14. More specifically, the door closing device 10 advantageously includes a housing or cylinder 16 with a first end 18 rotatably secured to the door 12 by any suitable means, such as a door bracket 20 attached to the door 12. The housing 16 advantageously is configured to contain a hold-open mechanism in accordance with the description below. The housing 16 also has a second end 22 from which a closer rod 24 movably extends. The closer rod 24 has an inner end 26 (FIG. 2) within the housing 16 that is linked to the hold-open mechanism contained therein so that the closer rod 24 is linearly movable between a withdrawn or retracted (door-closed) position and an extended (door-opened) position, as will be described below. The hold-open mechanism is configured to maintain the door 12 open at a predetermined hold-open angle $\alpha$, as shown in phantom in FIG. 1. In some embodiments, the hold-open angle $\alpha$ is about 85 degrees, although hold-open angles of between about 60 degrees and 90 degrees may be suitable, depending on the application. The closer rod 24 has an outer end 27 that is secured to the door jamb 14 by suitable means, such as a door jamb bracket 28. Although the device 10 is shown installed near the top of the door 12 and jamb 14, it may be installed near the middle or the bottom, in accordance with functional, structural, and/or aesthetic considerations.

As shown in FIGS. 2-5, a hold-open mechanism in accordance with an embodiment of the disclosure is contained within the housing or cylinder 16 in combination with a pneumatic mechanism. The hold-open mechanism includes a driver or driver mechanism 40 fixed on the closer rod 24, and a retainer 50 through which the closer rod 24 extends. The housing 16 also contains a piston 30 to which the inner end 26 of the closer rod 24 is connected, and a biasing mechanism, such as a spring 33, that biases the closer rod 24 towards its retracted or withdrawn position, whereby the door 12 to which the closing device 10 is fixed, when opened, is urged to return to its closed position. The spring 33 is advantageously a coil spring that surrounds the rod 24, the driver 40, and the retainer 50. In some embodiments, the spring 33 is located outside the housing 16.

The housing or cylinder 16 has an interior wall 19 that defines a hollow bore, with the first and second ends 18, 22 of the housing 16 at least partially closed to contain the piston 30, the driver 40, and the retainer 50 within the bore of the housing 16. In one example, the interior wall 19 of the housing 16 defines a cylindrical bore. The first and second ends 18, 22 of the housing can be partially closed by rolling the periphery inwardly using a standard end closing process. A mounting attachment 23 can be attached to the first end 18 of the housing 16 to rotatably couple the housing 16 to the door bracket 20. The mounting attachment 23 can also serve a secondary purpose by forming a seal at the first end 18 of the housing or cylinder 16. In embodiments employing the pneumatic mechanism, a valve 29 can be provided in the mounting attachment 23 to control a rate of airflow into and out from a pressure chamber 16*a* defined in the housing 16 between the piston 30 and the first end 18 of the cylinder or housing 16. In one embodiment, the valve 29 can also function as a fastener. The piston 30 can have a circumferential groove 31 with an annular piston seal, such as an O-ring 32, seated therein to form a seal against the interior wall 19 of the housing 16. The piston 30 is slidable inside the bore of the housing 16 and moves with the closer rod 24. Thus, the piston 30 can experience both the biasing force of the spring 33 and pressure inside the pressure chamber 16*a*, depending on the rate of airflow into and out of the pressure chamber 16*a* through the valve 29.

A kick chamber 17 may be formed to provide a localized increase in bore size adjacent the first end 18 of the housing 16. When the O-ring 32 on the piston reaches the kick chamber 17, the seal between the O-ring 32 and the interior wall 19 of the housing 16 is broken. The broken seal causes additional air to leak from the pressure chamber 16*a*, thereby reducing the pressure in the pressure chamber 16*a* and resistance against the spring 33. As a result, the door 12 can move to its closed position at a faster rate when the closer rod 24 is near the withdrawn position or when the door is almost closed. This can be defined as the kick phase. In some embodiments, the last 2-4% of the door closing is in the kick phase to ensure a latching mechanism of the door 12 is fully engaged.

The retainer 50 is mounted inside the housing 16 and is configured to hold the closer rod 24 in the extended position when the door 12 is at or slightly past the hold-open angle a. The retainer 50 comprises a plurality of resilient or elastic securing arms 52 separated by axial slots. Each of the securing arms 52 extends axially into the bore of the cylinder from an annular fitting 54 to a free end that terminates into a snap hook 53, further discussed below. The securing arms 52 define a retainer bore 51 in the retainer 50 through which the closer rod 24 extends. The annular fitting 54 includes a plurality of nubs 55*a*, each of which snaps into a corresponding opening (not shown) in an end cap 58 so as to secure the annular fitting 54 to the end cap 58. The end cap 58, in turn, is secured to the interior of the second end 22 of the cylinder 16. Slots can be provided extending from opposite sides of the nubs 55*a* into the annular fitting 54 to form elastic mounting arms 55 that allow the nubs 55*a* to deflect radially so as to snap into corresponding openings of the end cap 58. As shown, there are six nubs 55*a* extending into the slot openings. However, the number of nubs 55*a* can vary. Furthermore, the retainer 50 can be fixed to the second end 22 by means other than using nubs 55*a*, such as detents and fasteners.

Figure 2:
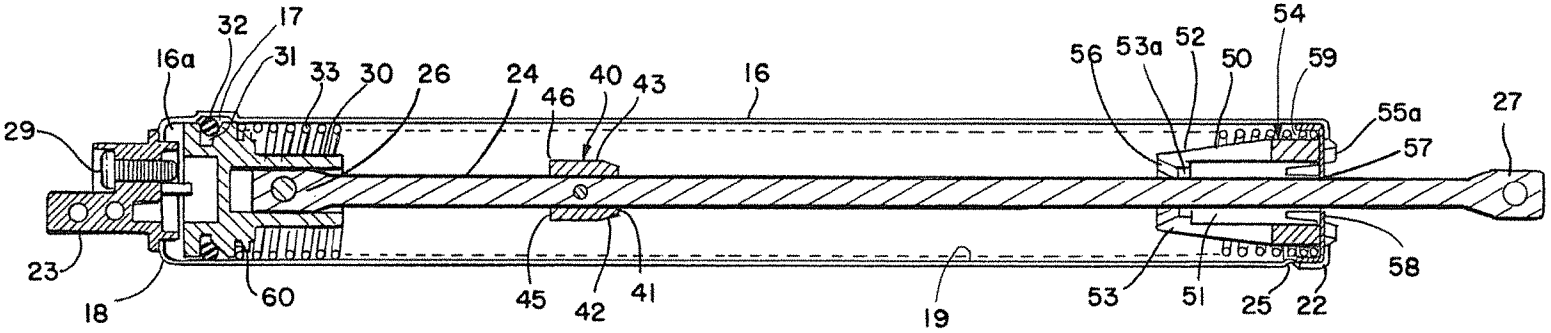
FIG. 2 is a longitudinal cross-sectional view of an embodiment of a hold-open mechanism for use in the door closing device in accordance with one embodiment of the disclosure, showing the mechanism in a "door-closed" position.

The end cap 58, in some aspects, has an annular cavity 59 defined around the annular fitting 54, in which is seated one end of the spring 33, with the other end of the spring 33 pressing against an annular shoulder 60 of the piston 30, as shown in FIG. 2. The end cap 58 defines an aperture or opening 57 through which the closer rod 24 extends. In some embodiments, the aperture 57 can have a size smaller than the size or outer diameter of the driver 40 to prevent the driver 40 from passing through the end cap 58. In such embodiments, the maximum angle the door 12 can be opened may occur when the driver 40 contacts the end cap 58 or the piston 30 contacts the retainer 50. In other embodiments, the aperture 57 of the end cap 58 can be larger than the diameter of the driver 40. After the piston 30 and the retainer 50 are installed into the housing 16, the first and second ends 18, 22 can be closed by a standard end closing operation. Additional post-processing can be performed on the housing 16 to form a roll form or dimple 25 extending inwardly at or immediately adjacent the end cap 58 to further restrain the end cap 58 between the roll form or dimple 25 and the second end 22.

The securing arms 52 can be evenly spaced around a central axis to hold the driver 40, thereby holding the door 12 open to the hold-open angle α. The securing arms 52 may also extend radially inwardly towards the first end 18 of the housing 16 to form a conical shape to provide room for the securing arms 52 to deflect outwardly without contacting the spring 33, when engaging the driver 40 as further discussed below. As shown, there are six securing arms 52 evenly spaced around the axis of the retainer 40. For simplicity, these six securing arms 52 will be discussed, although any number of securing arms 52 can be used for the retainer 50. The retainer bore 51 inside the securing arms 52 receives the driver 40, and the securing arms 52 hold the driver 40 within the bore 51 to hold the door 12 open at or slightly beyond the hold-open angle α. In some embodiments, the retainer bore 51 may be slightly smaller than the size or outer diameter of the driver 40 to provide some positive pressure against the driver 40 when the driver 40 is in the retainer bore 51. In other embodiments, the retainer bore 51 may be the same size or larger than the size of the driver 40. The retainer 50 can be made of a hard plastic or any suitable equivalent. For example, the retainer can be made of a single piece injection molded plastic component. In one embodiment, the retainer 50 can be made of 30% glass filled Nylon.

The driver 40 has an outer surface 43, a front end 41 (defined as the end closer to the retainer 50), and a back surface or back end 45 (defined as the end farther from the retainer 50). In some embodiments, the driver 40 is generally cylindrical. A tapered or frusto-conical surface 42 that tapers inwardly from the outer surface 43 towards the front end 41 can be provided to facilitate engagement with the retainer 50. For example, the taper angle defined between the tapered surface 42 with respect to the axis of the driver 40 can be less than 15 degrees, between 15 degrees and 30 degrees, or at most 45 degrees. In other examples, the tapered surface 42 can be a rounded surface or a plurality of angled surfaces connected together to facilitate engagement with the retainer. The angle of the tapered surface 42 can affect the force required to engage the retainer 50, as discussed below. The driver 40 may also have a radius or chamfer 46 at the corner between the outer surface 43 and the back end 45 to facilitate separating the driver 40 from the retainer bore 51 and securing arms 52, also discussed below.

The driver 40 can comprise of one or more components assembled on the closer rod 24. A retaining component (not shown) can be threaded through the one or more components to secure the driver 40 at a predetermined location along the closer rod 24. The retaining component can be a roll pin, snap hook, bolt, or any other fastener. The retaining component may also extend through a hole in the closer rod 24 to further prevent the driver 40 from sliding along the closer rod 24. The location of the driver on the closer rod 24 can determine the hold-open angle α. Other factors that may determine the hold-open angle a include the location of the retainer 50 in the housing 16 and length of the securing arms 52. For example, the longer the securing arms 52, the smaller the hold-open angle α. In some embodiments, the driver 40 can be integrally formed with the closer rod 24. The driver 40 can be made from a hard material, preferably a metal, such as, for example, die cast zinc or any suitable equivalent.

FIG. 2 illustrates a cross-sectional view of the door closing device 10 with the hold-open mechanism in the "door-closed" position. In this position, which may also be termed the "initial" or "rest" position, the spring 33 urges the closer rod 24 to its withdrawn position. The spring 33 may urge the closer rod 24 to its withdrawn position by pressing against the end plate 58 and the piston 30. With the closer rod 24 in the withdrawn position, the door 12 is in its closed position or state.

Figure 3:
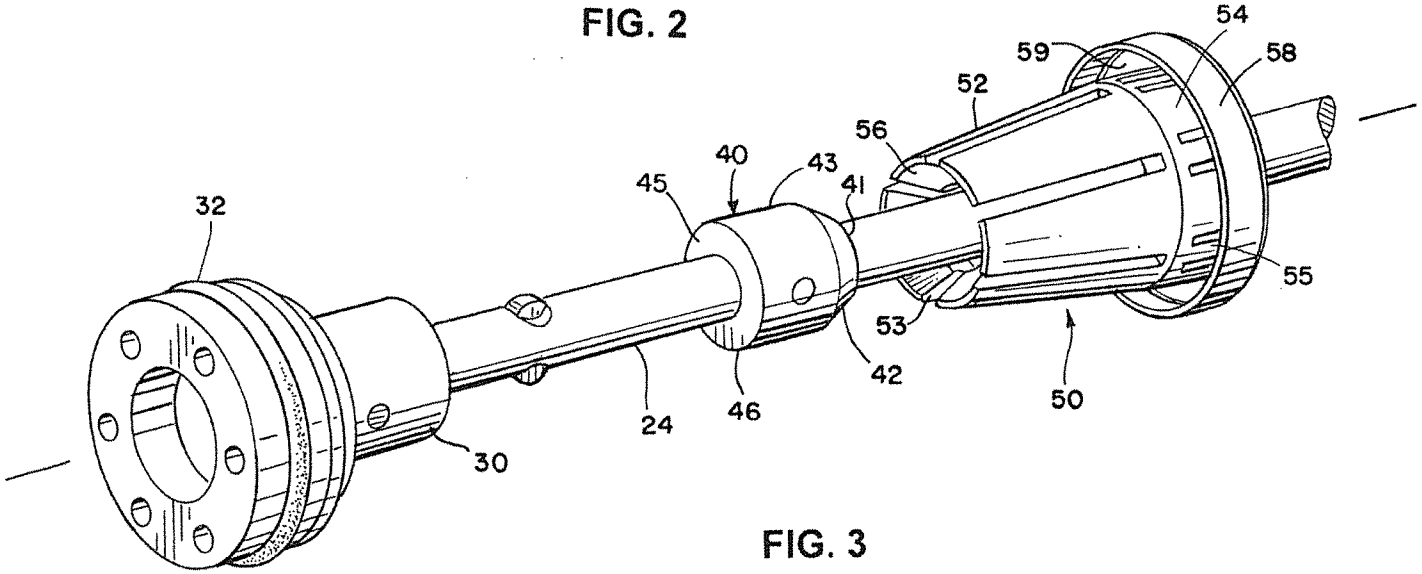
FIG. 3 is a perspective view of the hold-open mechanism of FIG. 2, showing the mechanism in a position with the door partially opened.

Referring now to FIG. 3, the hold-open mechanism is shown when the door 12 is partially opened. For example, the driver 40 on the closer rod 24 may be moved towards the retainer 50 in response to the opening of the door 12 from the closed position (FIG. 2). The movement between the door 12 relative to the door jamb 14 moves the driver 40 which is fixed on the closer rod 24. As shown, each of the securing arms 52 of the retainer 50 has a tapered surface 56 which cooperatively form a tapered opening extending from the free ends of the securing arms 52 inwardly towards the retainer bore 51. The movement of the closer rod 24 carries the piston 30 and the driver 40 forward towards the tapered surfaces 56 of the securing arms 52. A taper angle can be defined between the tapered surface 56 with respect to the axis of the retainer 50. For example, the taper angle can be less than 15 degrees, between 15 degrees and 30 degrees, or at most 45 degrees. In some embodiments, the taper angle of the tapered surfaces 56 of the securing arms 52 matches the taper angle of the tapered surfaces 42 of the driver 40, such as at the moment the driver 40 contacts the retainer 50 or during deflection of the securing arms 52. Alternatively, the securing arms 52 may not have a tapered surface 56 but a rounded or sharp corner.

Figure 4:
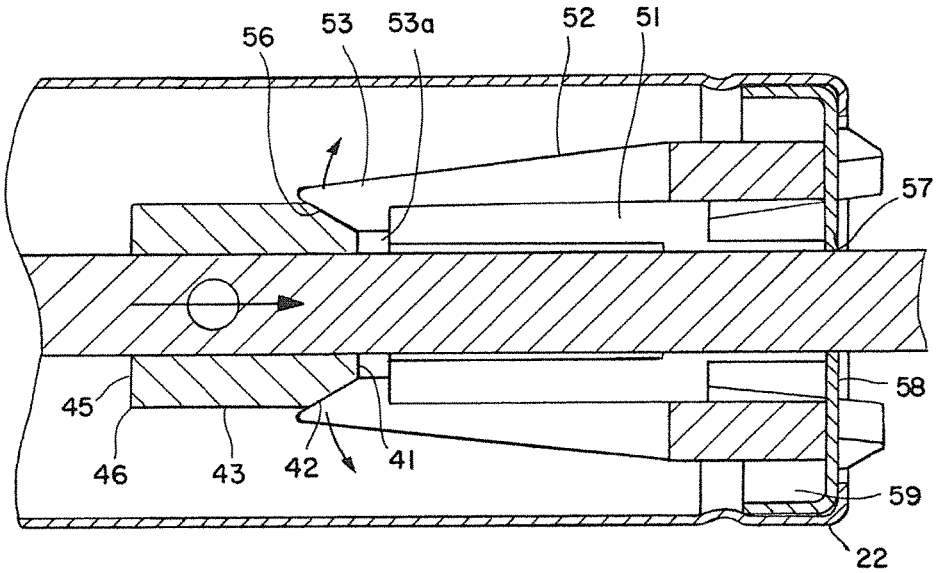
FIG. 4 is a partial longitudinal cross-sectional view of the door closing device of FIG. 2, showing a driver of the hold-open mechanism entering into engagement with a retainer of the device.

FIG. 4 illustrates a close-up cross-sectional view of driver 40 and the retainer 50 of the closing device 10 at the moment the driver 40 begins to engage the retainer 50, with the spring 33 removed for clarity. As shown, the tapered surface 42 of the driver 40 is pressed against the inwardly tapered surfaces 56 of the securing arms 52. The front end of the securing arms 52 provides a slight resistance to the driver 40 from moving towards the retainer bore 51. An additional opening force can be applied to the door 12 to advance the driver 40 against the securing arms 52 thereby causing the securing arms 52 to deflect radially outwardly so that the driver 40 can squeeze through the opening defined by the free ends of the securing arms 52 into the retainer bore 51, where the door 12 can be held open at or near the hold-open angle α. Said differently, when the door 12 is opened and approaches the hold-open angle α, the user opening the door 12 may feel the slight resistance offered by the retainer to further opening. The user can then apply the additional opening force to the door 12 to deflect all the securing arms 52 outwardly until the door 12 is at or slightly past the hold-open angle α. The user can then release the door 12 at which point the door 12 will remain open at or near the hold-open angle α, as detailed below. If the user releases the door 12 when the door 12 is past the hold-open angle α, the door 12 can close slightly until the door 12 is at or near the hold-open angle α, as further discussed below.

Factors which can affect the additional opening force can include the length of the securing arms 52 and the cross-section of the securing arms 52 along the length of the securing arms 52. Longer securing arms 52 and smaller area moments of inertia can reduce the opening force required to elastically deflect the securing arms 52. The material of the securing arms 52, and the surface finish of the contacting surfaces or friction between the driver 40 and the securing arms 52 can also affect the force required to deflect the securing arms 52. Surface features between the driver 40 and the securing arms 52, such as the taper angle of the tapered surfaces 42, 56 of the driver 40 and the securing arms 52, respectively, can determine how gradual the additional opening force can be applied to the door 12. In one example, if the tapered surfaces 42, 56 are gradual, then the additional opening force can be applied gradually to initiate and continue to deflect the securing arms 52. In another example, if the tapered surfaces 42, 56 are abrupt or not smooth, then a sudden increase in additional opening force may be needed. Thus, the surface features between the driver 40 and the securing arms 52 can be selected to achieve the desired force over time to deflect the securing arms 52 and move the door 12 into the hold-open position. The additional opening force can be applied to the door 12 until the door 12 is at or slightly past the hold-open angle α, at which time the driver 40 is captured inside the retainer bore 51.

Figure 5:
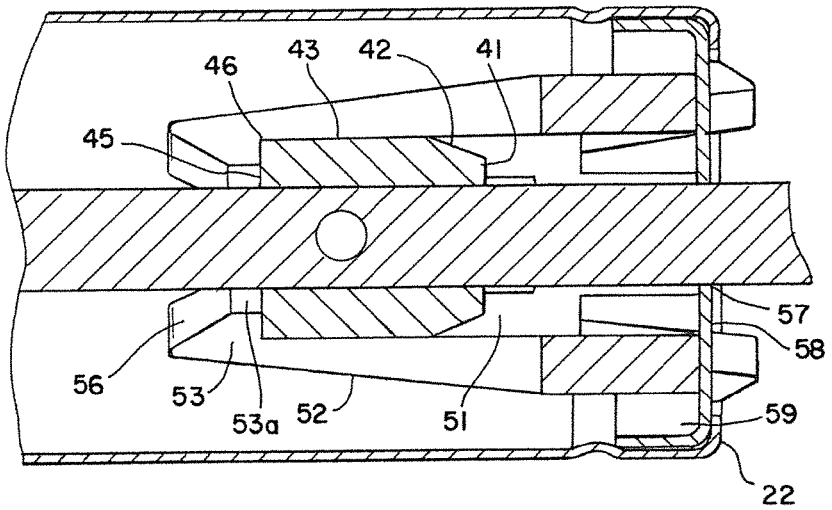
FIG. 5 is a close-up side cross-sectional elevational view of the door closing device of FIG. 2, showing the driver fully engaged with the retainer of the device in a door "hold-open" position.

Referring to FIG. 5, the snap hook 53 provided at the free end of each securing arm 52 is bounded by the inwardly tapered surface 56 and the retainer bore 51. The snap hook 53 comprises a protrusion 53*a* extending radially inward to capture the driver 40 in the hold position and prevent the driver 40 from leaving the retainer bore 51. That is, the securing arms 52 capture the driver 40 when the door 12 is opened to or slightly past the hold-open angle a. The moment the driver 40 is completely received inside the retainer bore 51, and the securing arms 52 and snap hooks 53 are no longer elastically deflected outwardly by the driver 40, the securing arms 52 can elastically snap back into their original configuration, thereby advantageously producing, according to aspects of the disclosure, an audible sound. The audible sound can indicate that the driver 40 is captured in the retainer 50 and the door is held open at or near the hold-open angle α. When the driver 40 is captured in the retainer bore 51, the snap hooks 53 block the driver 40 from moving outside the retainer bore 51 towards the withdrawn position. More specifically, the protrusion 53*a* can retain the driver 40 in the retainer bore 51 by blocking the back end 45 of the driver 40 against the force of the spring 33. Thus, the snap hooks 53 keep the door open at the hold-open angle αby preventing the door 12 from closing.

The door 12 can also be designed to be opened slightly past the hold-open angle αand released to allow the door 12 to move back towards the closed position until the door 12 rests at the hold-open angle αwhere it is held. That is, when the driver 40 is moved slightly further into the retainer bore 51 beyond the extended position, the back end 45 of the driver 40 will move towards the protrusions 53*a* under the force of the spring 33 until the back end 45 abuts against the protrusions 53*a*. Thus, the door closing device 10 can be designed to allow a user to open the door 12 slightly past the hold-open angle a and allow the door closing device to close the door 12 until the door 12 is held at or near the hold-open angle α. In some embodiments, if the door 12 is opened at least a certain distance past the hold-open angle a, the door closing momentum generated by the spring 33 after the door 12 is released, may produce an impact force sufficient to overcome the snap hooks 53, as further discussed below.

In the hold-open position, the back end 45 of the driver abuts against the protrusions 53*a* of the snap hooks 53 of the retainer 50. To release the door 12 held open in the hold-open position, a closing force can be applied to the door 12 in a direction towards the door-closed position to separate the driver 40 from the retainer 50. The closing force can be sufficiently large enough for the driver 40 to overcome the hold of the snap hooks 53. With sufficient closing force, the back end 45 can press against the snap hooks 53 and thereby cause the securing arms 52 to deflect radially outwardly so that the driver 40 can squeeze between the securing arms 52 out from the retainer bore 51 towards the withdrawn position. In some embodiments, the force applied to the door 12 may be about 5 pounds when measured in a non-dynamic (static) condition, although the magnitude of the closing force may differ considerably from this figure in certain applications.

The door 12 may also be closed by opening the door 12 at least a predetermined amount beyond the hold-open position, thereby compressing the spring 33 further, and then releasing the door 12 to allow sufficient door closing momentum from the spring 33 to produce an impact force sufficiently large to overcome the grasp of the snap hooks 53. Said differently, the impact force of the back end 45 of the driver 40 against the snap hooks 53 causes the securing arms 52 to deflect radially outwardly so that the driver 40 can advance between the securing arms 52 out from the retainer bore 51 towards the withdrawn position. To reduce the closing force, the radius or chamfer 46 at the corner between the outer surface 43 and the back end 45 can be provided to facilitate separating the driver 40 from the retainer bore 51 by deflecting the securing arms 52 outwardly as the driver 40 squeezes through the opening defined by the free ends of the securing arms 52. Once the driver 40 is released from the retainer 50, the spring 33 of the door closing device 10 automatically closes the door 10.

Although exemplary embodiments of the disclosure are illustrated and described herein, a number of variations and modifications will make themselves apparent to those skilled in the art. Such variations and modifications are understood as being encompassed within the spirit and scope of the disclosed subject matter, and all such changes and modifications are intended to be encompassed within the appended claims.

What is claimed is:

1. A door-closing device configured to be connected between a door and a door jamb so as to bias the door from an open position toward a closed position against the door jamb, the door-closing device comprising:

a closer rod having an end configured to be secured to the door jamb, the closer rod being movable between a withdrawn position in which the door is closed and an extended position in which the door is opened; and a hold-open mechanism, comprising:

a driver fixed to the closer rod and movable with the closer rod between a release position that permits movement of the closer rod, and a hold position that holds the closer rod in the extended position, the driver having a first end and a second end opposite the first end, the first end of the driver and the second end of the driver being at a fixed distance relative to each other; and a resilient retainer defining a retainer bore through which the closer rod extends for connection to the door jamb, the retainer being configured to capture the driver in the retainer bore when the driver is in the hold position, and to release the driver from the retainer bore in response to a disengagement force applied by the second end of the driver to the retainer.

2. The door-closing device of claim 1, wherein the resilient retainer comprises at least one resilient arm having a free end terminating in a snap hook configured to engage the second end of the driver when the driver is in the hold position, and wherein the retainer is configured to produce an audible sound when the driver is captured in the hold position by engagement of the snap hook with the second end of the driver.

3. The door-closing device of claim 2, wherein the retainer is further configured to produce an audible sound when the driver is separated from the retainer.

4. The door-closing device of claim 1, wherein the resilient retainer comprises at least one resilient arm having a free end terminating in a snap hook, wherein the second end of the driver is engaged by the snap hook to capture the driver in the hold position, and wherein the disengagement force is applied by the second end of the driver to the snap hook.

5. The door-closing device of claim 1, wherein the retainer bore is defined by a plurality of arms configured to releasably capture the driver.

6. The door-closing device of claim 1, further comprising a spring surrounding the driver and the resilient retainer, wherein the spring is configured to bias the closer rod toward the withdrawn position.

7. The door-closing device of claim 6, wherein the resilient retainer includes at least one resilient arm, and wherein the first end of the driver has a tapered surface configured to deflect the at least one resilient arm radially outwardly as the first end of the driver enters the retainer bore.

8. A hold-open mechanism for a door-closing device, the door-closing device including a linearly-movable closer rod having a first end configured to be fixed to a door jamb and an opposite second end, the closer rod being movable between a door closed position and a door open position relative to the door jamb, wherein the closer rod is moved to an extended position when the door is opened, and wherein the closer rod is biased to return to a withdrawn position from the extended position, wherein the hold-open mechanism comprises:

a driver element having a first end and a second end, the first end of the driver element and the second end of the driver element being at a fixed distance relative to each other, wherein the driver element is fixed to the closer rod between the first and second ends of the closer rod; and a resilient retainer defining a retainer bore through which the second end of the closer rod extends, the retainer being configured to hold the driver element when the closer rod is in the extended position, and to release the driver element in response to a disengagement force applied by the second end of the driver element to the retainer as the closer rod is returned from the extended position to the withdrawn position.

9. A door-closing device configured to be connected between a door and a door jamb so as to bias the door from an open position toward a closed position against the door jamb, the door-closing device comprising:

a housing defining a hollow interior and having a first end and an opposite second end, the second end having an opening;

a piston movable linearly through the interior of the housing;

a retainer in the interior of the housing and fixed to the second end of the housing, the retainer comprising a plurality of resilient arms cooperatively defining a retainer bore;

a closer rod disposed in the interior of the housing and having a first end secured to the piston and a second end extending through the opening in the second end of the housing, the closer rod extending through the retainer bore and moveable linearly through the interior of the housing between a withdrawn position and an extended position;

a biasing element in the bore and engageable with the piston so as to bias the piston toward the first end of the housing, thereby biasing the closer rod toward the withdrawn position; and a driver fixed to the closer rod between the first and second ends of the closer rod, the driver having a first end and a second end at a fixed distance relative to each other, the resilient arms of the retainer being configured to be resiliently deflected radially outward from an original state when the first end of the driver enters the retainer bore as the closer rod is moved from the withdrawn position to the extended position, the resilient retainer arms being further configured to engage the second end of the driver when the second end of the driver enters the retainer bore, and to release the driver from the retainer bore in response to a disengagement force applied by the second end of the driver to the retainer.

10. The door-closing device of claim 9, wherein the resilient arms are further configured to be resiliently deflected radially outward when the second end of the driver exits the retainer bore as the closer rod is moved from the extended position to the withdrawn position.

11. The door-closing device of claim 9, wherein at least some of the resilient arms have a free end terminating in a snap hook that releasably engages the second end of the driver to capture the driver in the retainer bore.

12. The door-closing device of claim 9, wherein the second end of the driver is configured to urge the resilient arms radially outward to release the driver from the retainer bore as the closer rod is moved from the extended position to the withdrawn position.

* * * * *